United States Patent [19]

Faulk

[11] 3,991,513

[45] Nov. 16, 1976

[54] COMBINATION GAME CALL

[76] Inventor: Paul Dudley Faulk, 616 18th St., Lake Charles, La. 70601

[22] Filed: July 29, 1975

[21] Appl. No.: 600,115

[52] U.S. Cl. ..... 46/180

[51] Int. Cl.[2] ..... A63H 5/00

[58] Field of Search ..... 46/177, 178, 180

[56] References Cited

UNITED STATES PATENTS

| | | | |
|---|---|---|---|
| 3,029,554 | 4/1962 | Mobley | 46/177 |
| 3,406,479 | 10/1968 | Faulk | 46/178 |
| 3,656,258 | 4/1972 | Thomas | 46/180 |

*Primary Examiner*—Louis G. Mancene
*Assistant Examiner*—Robert F. Cutting
*Attorney, Agent, or Firm*—Cushman, Darby & Cushman

[57] ABSTRACT

A combination animal or fowl call device is disclosed, wherein a pair of conventional call barrels, each with associated trough elements and reeds, are mounted in either end of a common throat element. The throat element has an aperture connecting the inner sound chamber thereof with the atmosphere. Suitably, one throat element and associated reed produces the sound of a duck, whereas the other throat element and associated reed produces the sound of a goose. As the pitch of the call may be changed by partially closing the aperture (as long as the aperture is left partially open), a single call can produce the sounds of, e.g. a Black Duck, a Mallard, a Snow-or-Blue Goose and a Canadian Goose.

Thus, it is possible using the call device of the present invention to produce the sounds of numerous animals or fowl from a single such device.

12 Claims, 3 Drawing Figures

COMBINATION GAME CALL

BACKGROUND OF THE INVENTION

The present invention relates to a combination call device, capable of reproducing the sounds of a plurality of animals or fowl. In particular, the present invention is directed to a combinaton duck and goose call, wherein instant pitch modification of the call is possible.

The Wootten U.S. Pat. No. 582,890 relates to a Campaign Horn which can receive a blast of air from either end. The device has an intermediate side opening, with a swinging device pivotally mounted in the opening, to be swung outward by the air blast.

The Canney U.S. Pat. No. 387,338 relates to a Wind Instrument which comprises a cylinder having a solid partition mounted therein. On opposite sides of the partition are mounted movable pistons to which are secured the ends of reed pipes or horns containing vibratory reeds. During operation, the cylinder is moved relative to the horns, causing air to be intermittently admitted through each horn and passed out through the reed openings.

The Eisenstein U.S. Pat. No. 751,153 relates to a Musical Cane having a double reed mounted in one end of the cane, and opening to a hollowed section of the cane. The hollowed section of the cane is connected to the atmosphere by a series of apertures. Sounds may be produced by blowing through a mouthpiece or through the various apertures.

The Reynolds U.S. Pat. No. 827,819 relates to a duck call having a double reed, which can be blown from either end.

The Fahey U.S. Pat. No. 2,551,367 relates to a Plural Tone Duck Call which contains two separate reeds, which can be operated separately or at the same time, depending upon the selection of air passages through a rotatable cap.

The Testo U.S. Pat. No. 3,054,216 relates to a combination Call Device, wherein a plurality of calls, each with its own associated mouthpiece sounding trough reed and throat element, are mounted in abutting or side-by-side relationship.

Pritchard et al. U.S. Pat. No. 3,466,794 relates to a fowl caller which has a plurality of passages holding reed-equipped, sound-emitting callers. A rotary mouthpiece is used to select a given passage.

SUMMARY OF THE INVENTION

My copending application entitled COMBINATION GAME CALL, filed Dec. 16, 1974, Ser. No. 533,165, discloses a combination animal or fowl call device having a single, central sound chamber, with mouthpieces and air-responsive sounding devices located in each end of the sound chamber. A single aperture is located in the wall of the sound chamber, and connects the interior of the sound chamber to the atmosphere.

The user may blow air through either mouthpiece to actuate the sounding device contained therein. The air passing through the sounding device passes to the central sound chamber, from whence it is discharged to the atmosphere through the aperture.

The aperture is maintained in the at least partly open condition, but the size of the aperture opening may be changed to produce desired changes in pitch of the call.

DETAILED DESCRIPTION OF THE INVENTION

The invention will be more clearly understood with reference to the accompanying drawings, wherein FIG. 1 is an elevational view of the combination call device of the present invention;

Figure 1:
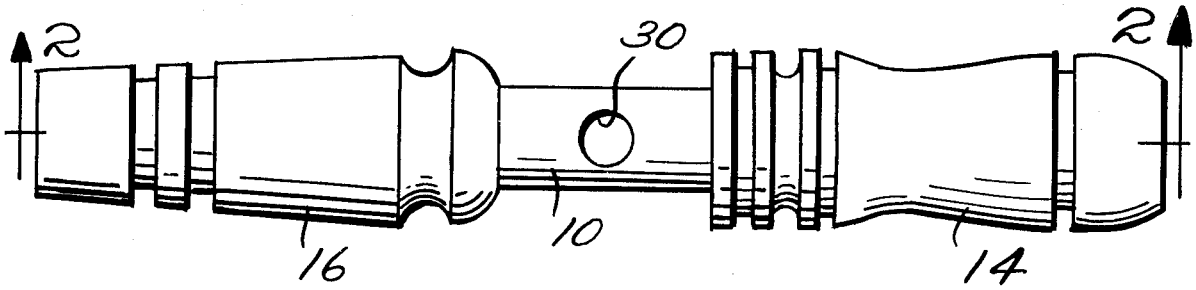
Figure 2:
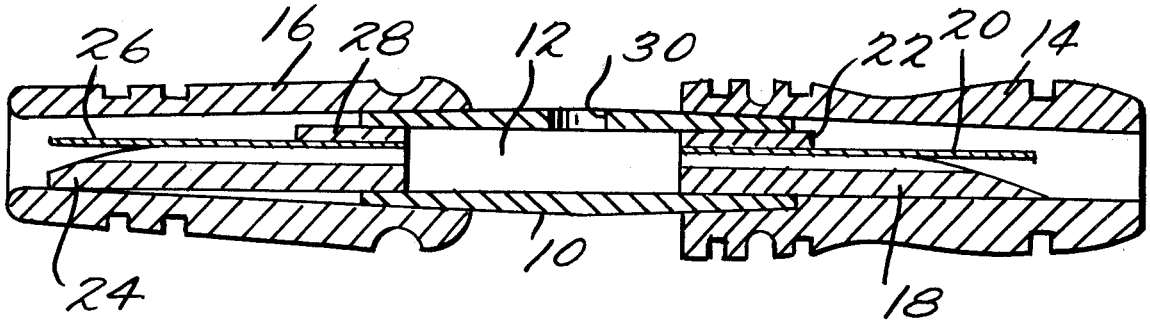
FIG. 2 is a cross-sectional view of the call device of FIG. 1, taken along line 2 — 2.

In FIGS. 1 and 2, housing 10 defines central sound chamber 12. Goose-call mouthpiece 14 is located on one end of housing 10, and duck-call mouthpiece 16 is located on the other end. Goose-call mouthpiece 14 has an associated trough element 18, reed 20, and wedge 22, mounted in one end of housing 10 and surrounded by mouthpiece 14. Mounted in the other end of housing 10 are trough element 24, reed 26, and wedge 28, which produce the sound of a duck. These elements are surrounded by barrel 16. Mouthpieces 14, 16 are generally frustoconically flared on their inner ends to removably receive and frictionally retain sound chamber 10. Sound chamber 10 itself is generally frustoconically flared on each end of sound chamber 12 to removably receive and frictionally retain the assembly of trough elements 18 or 24, reeds 20 or 26, and wedges 22 or 28, respectively.

Aperture 30 is located in the walls of housing 10 and connects sound chamber 12 to the atmosphere.

It is greatly preferred for ease of construction to have housing 10 and mouthpieces 14, 16 tubular in nature, but it will be readily appreciated that other configurations, while decidedly less preferred, may be used if desired.

The trough elements, reed, wedges, and mouthpieces are conventional, and any of the normal designs may be used if desired. For instance, the design described in my U.S. Pat. No. 3,406,479 may be used if desired. The disclosure of that patent is hereby incorporated by reference.

From consideration of FIG. 2, it will be appreciated that when blowing on one end of the call device, minor amounts of air may escape out the other end of the device, through the opposite trough and barrel. However, most of the air blown into the device will pass out of aperture 30.

In addition to the selection of conventional troughs and reeds, other variables in the call device of the present invention include the size of the central sound chamber, the aperture size, the aperture location, the shape of the aperture, and the like.

Within these variables, the proper selection of design parameters can be readily chosen by those in the art to produce the desired sounds. As an illustration of a suitable call, a housing 10 having an internal diameter of ½ inch and a space of about 2 inches between the inner ends of wedges 22, 28 is quite suitable. A round aperture having a diameter of ⅜ inch can conveniently be used.

For ease of fabrication, the call of FIGS. 1 and 2 preferably has round apertures. However, aperture 30 may be replaced by an elongated slot, by a square aperture, or other configurations, as desired.

Figure 3:
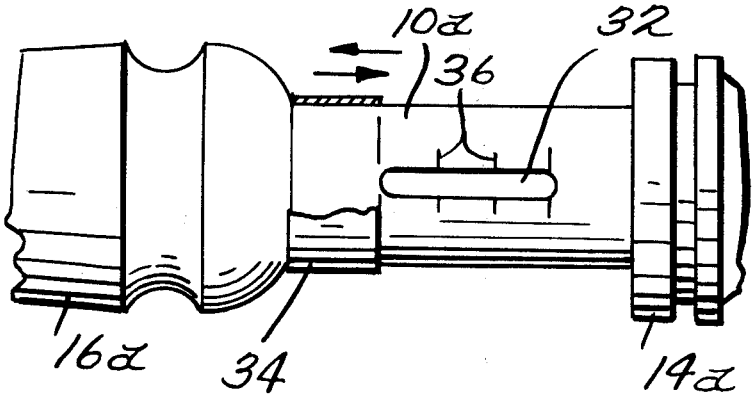
FIG. 3 illustrates a different embodiment of the design of the call device.

FIG. 3 represents an alternative embodiment of the call device of the present invention, wherein mouthpieces **16*a* and 14*a* generally correspond to mouthpieces 16 and 14 of FIG. 1, and housing 10*a* generally corresponds to housing 10 of FIG. 1, except aperture 30 is replaced by aperture 32, which is in the form of an elongated slot. Movable sleeve 34 is mounted upon housing 10***a*, and serves to partially block portions of slot 32, in order to change the pitch of the calls produced using either mouthpiece. Means (not shown) may be used to hold sleeve 34 in a predetermined position. The assembly of trough elements, reeds and wedges within mouth-pieces 16*a* and 14*a* are the same as in FIG. 1.

Reference indexes may be placed along the length of slot 32, as illustrated by indexes 36, to indicate certain positions for sleeve 34.

While the combination call device of the present invention has been described hereinabove as a combinaton duck-goose call, it will be readily appreciated that other combinations of fowl or animal calls may be used as desired. For instance, one end of the call could be a speckled-belly goose call, whereas the other end of the call could be a conventional snow- or blue-goose call. Alternatively, one end of the call could produce a conventional mallard duck sound, whereas the other end of the call could be a pintail duck whistle. Conventional mallard calls could be used on either end of the call device, with differences in tone/pitch so that a considerable latitude of tone and pitch could be achieved, especially when using the sleeve 34 of FIG. 3. Furthermore, one end of the call could be a high-pitched predator call, and the other end could be a deep-tone predator call. Other combinations will be readily apparent to those working in the art.

While it is preferred that the various components of the call device be frictionally retained together, it will be appreciated that components may be adhered together or otherwise joined, e.g., by solvent welding plastic parts. The reed may be of any conventonal material, such as of plastic (including nylon, polyethylene, polypropylene, polyvinylchloride and copolymers thereof, etc.) or metal. The mouthpieces, the sound chamber, and the trough elements are preferably of wood, but plastic or other materials could be used.

Generally the aperture will have a size equivalent to the area of a circular hole ⅛ inch to ¾ inch in diameter. It is preferred that the aperture have a size corresponding to the area of a circular hole ⅜ inch in diameter. However, as mentioned hereinabove, the size of the aperture may be varied over a wide range, depending upon the desired type of call and pitch and tone thereof. Furthermore, the aperture size may depend to some degree upon other variables in the call construction.

I claim:

1. A combination animal or fowl call device comprising wall means having two ends and defining a central sound chamber, mouthpiece means located at each end of said wall means and including a passageway connected to said chamber, air-responsive sounding means in each passageway, and an aperture means located in said wall means for controlling the passage of air through said call device to produce the desired animal or fowl sound.

2. Call device of claim 1, wherein said aperture means is a circular hole.

3. Call device of claim 2 wherein said air-responsive sounding means include a trough with a channel thereon, and a reed overlying said channel.

4. Call device of claim 3, wherein the sounding means in one passageway simulates the sound of a duck, and the sounding means in the other passageway simulates the sound of a goose.

5. Call device of claim 2, wherein said hole has a diameter of about ⅜ inch.

6. Call device of claim 1, wherein said aperture means is an elongated slot.

7. Call device of claim 6, including a movable sleeve means mounted on said wall means and serving to close a preselected portion of at least part of said elongated slot.

8. A combination duck and goose call comprising a central sound chamber defined by a tubular throat element, a channeled trough element mounted in each end of the tubular throat element, a duck call reed mounted in sound-producing relationship to the channel of one throat element, a goose call reed mounted in sound-producing relationship to the channel of the other throat element, a barrel surrounding each said trough element and associated reed, and an aperture in said throat element connecting the said chamber with the atmosphere so that blowing on one end of the barrel vibrates the duck call reed for producing simulated duck sounds and blowing on the other end of the barrel vibrates the goose call reed for producing simulated goose sounds.

9. Call of claim 8, wherein said aperture is a circular hole.

10. Call of claim 9, wherein said hole has a diameter of about ⅜ inch.

11. Call device of claim 8, wherein said aperture means is an elongated slot.

12. Call device of claim 8, including a moveable sleeve means mounted on said wall means and serving to close a preselected portion of at least part of said elongated slot.

* * * * *